US010480448B2

(12) United States Patent
Maki et al.

(10) Patent No.: US 10,480,448 B2
(45) Date of Patent: Nov. 19, 2019

(54) CYLINDER BORE HAVING VARIABLE COATING

(71) Applicant: FORD MOTOR COMPANY, Dearborn, MI (US)

(72) Inventors: Clifford E. Maki, New Hudson, MI (US); Larry Dean Elie, Ypsilanti, MI (US); Timothy George Beyer, Troy, MI (US); Arup Kumar Gangopadhyay, Novi, MI (US); Hamed Ghaednia, West Bloomfield, MI (US); James Maurice Boileau, Novi, MI (US)

(73) Assignee: Ford Motor Company, Dearborn, MI (US)

( * ) Notice: Subject to any disclaimer, the term of this patent is extended or adjusted under 35 U.S.C. 154(b) by 782 days.

(21) Appl. No.: 15/064,903

(22) Filed: Mar. 9, 2016

(65) Prior Publication Data

US 2017/0260926 A1 Sep. 14, 2017

(51) Int. Cl.
*F02F 1/00* (2006.01)
*C23C 4/129* (2016.01)
(Continued)

(52) U.S. Cl.
CPC ..... *F02F 1/004* (2013.01); *B05D 1/08* (2013.01); *C23C 4/02* (2013.01); *C23C 4/08* (2013.01);
(Continued)

(58) Field of Classification Search
CPC . F02F 1/004; C23C 4/131; C23C 4/08; C23C 4/02; C23C 4/129; B05D 1/08; B05D 2202/00
See application file for complete search history.

(56) References Cited

U.S. PATENT DOCUMENTS 3,077,659 A * 2/1963 Holzwarth ..... C23C 4/08 427/292
4,980,996 A 1/1991 Klink et al.
(Continued)

FOREIGN PATENT DOCUMENTS

DE 19711756 A1 9/1998
JP 58015742 A * 1/1983 ..... C23C 4/02

OTHER PUBLICATIONS

Yuan, Zhiwei GuoChengqing et al., Study on Influence of Cylinder Liner Surface Texture on Lubrication Performance for Cylinder Liner-Piston Ring Components, vol. 51, Issue 1, Jul. 2013, pp. 9-23.

*Primary Examiner* — Hung Q Nguyen
(74) *Attorney, Agent, or Firm* — Ray Coppiellie; Brooks Kushman P.C.

(57) ABSTRACT

Engine blocks and methods of forming the same are disclosed. The engine block may comprise a body including at least one cylindrical engine bore wall having a longitudinal axis and including a coating extending along the longitudinal axis and having a coating thickness. The coating may have a middle region and first and second end regions, and a plurality of pores may be dispersed within the coating thickness. The middle region may have a different average porosity than one or both of the end regions. The method may include spraying a first porosity coating in a middle longitudinal region of the bore and spraying a second porosity coating in one or more end regions of the bore. The first porosity may be greater than the second porosity and the first and second porosities may be formed during the spraying steps. The pores may act wells for lubricant.

20 Claims, 5 Drawing Sheets

(51) Int. Cl.

| | |
|---|---|
| ***B05D 1/08*** | (2006.01) |
| ***C23C 4/02*** | (2006.01) |
| ***C23C 4/08*** | (2016.01) |
| ***C23C 4/131*** | (2016.01) |

(52) U.S. Cl.
CPC ..... *C23C 4/129* (2016.01); *C23C 4/131* (2016.01); *B05D 2202/00* (2013.01)

(56) References Cited

U.S. PATENT DOCUMENTS

| | | | | |
|---|---|---|---|---|
| 5,344,494 | A | 9/1994 | Davidson et al. | |
| 5,380,564 | A | 1/1995 | VanKuiken, Jr. et al. | |
| 5,441,439 | A | 8/1995 | Grimm et al. | |
| 5,466,906 | A * | 11/1995 | McCune, Jr. ..... | B23K 9/048 219/121.47 |
| 5,592,927 | A | 1/1997 | Zaluzec et al. | |
| 5,820,938 | A | 10/1998 | Pank et al. | |
| 5,932,026 | A | 8/1999 | Trampusch | |
| 6,041,749 | A | 3/2000 | Lübbing et al. | |
| 6,379,754 | B1 | 4/2002 | Schlegel et al. | |
| 6,702,882 | B2 | 3/2004 | Barbezat | |
| 7,104,240 | B1 | 9/2006 | Vuk et al. | |
| 7,685,991 | B2 | 3/2010 | Cumming et al. | |
| 8,220,124 | B1 | 7/2012 | Morasch et al. | |
| 8,286,468 | B2 | 10/2012 | Nishimura et al. | |
| 8,726,874 | B2 | 5/2014 | Whitbeck et al. | |
| 9,387,567 | B2 | 7/2016 | Cryer et al. | |
| 9,556,819 | B2 | 1/2017 | Ernst et al. | |
| 2007/0071990 | A1 | 3/2007 | Suman | |
| 2010/0031799 | A1 * | 2/2010 | Ast ..... | B23B 27/06 83/875 |
| 2010/0288222 | A1 | 11/2010 | Urabe et al. | |
| 2012/0132069 | A1 | 5/2012 | Roh | |
| 2013/0055993 | A1 * | 3/2013 | Kantola ..... | C23C 4/10 123/668 |
| 2013/0131824 | A1 | 5/2013 | Meehan et al. | |
| 2013/0340700 | A1 | 12/2013 | Donahue | |
| 2014/0069272 | A1 | 3/2014 | Cryer et al. | |
| 2015/0027398 | A1 * | 1/2015 | Ernst ..... | F02F 1/00 123/193.2 |
| 2015/0218687 | A1 * | 8/2015 | Goedel ..... | C23C 4/04 29/888.061 |
| 2015/0322559 | A1 * | 11/2015 | Killian ..... | C23C 4/06 428/380 |
| 2017/0175668 | A1 | 6/2017 | Schepak et al. | |
| 2017/0260926 | A1 | 9/2017 | Maki et al. | |
| 2018/0058370 | A1 | 3/2018 | Amano | |

* cited by examiner

CYLINDER BORE HAVING VARIABLE COATING

STATEMENT REGARDING FEDERALLY SPONSORED RESEARCH OR DEVELOPMENT

The invention was made with Government support under Cooperative Agreement DE-EE0006901 awarded by the Department of Energy. The Government has certain rights to the invention.

TECHNICAL FIELD

This disclosure relates to cylinder bores having variable coatings, for example, variable porosity.

BACKGROUND

Engine blocks (cylinder blocks) may include one or more cylinder bores that house pistons of an internal combustion engine. Engine blocks may be cast, for example, from cast iron or aluminum. Aluminum is lighter than cast iron, and may be chosen in order to reduce the weight of a vehicle and improve fuel economy. Aluminum engine blocks may include a liner, such as a cast iron liner. If liner-less, the aluminum engine block may include a coating on the bore surface. Cast iron liners generally increase the weight of the block and may result in mismatched thermal properties between the aluminum block and the cast iron liners. Liner-less blocks may receive a coating (e.g., a plasma coated bore process) to reduce wear and/or friction.

SUMMARY

In at least one embodiment, an engine block is provided. The engine block may include a body including at least one cylindrical engine bore wall having a longitudinal axis and including a coating extending along the longitudinal axis and having a coating thickness; the coating having a middle region and first and second end regions, and a plurality of pores dispersed within the coating thickness, the middle region having a different average porosity than one or both of the end regions.

The middle region may have a greater average porosity than one or both of the end regions. In one embodiment, one of the end regions extends along a portion of the at least one engine bore wall that includes a top dead center (TDC) position or a bottom dead center (BDC) position of the at least one engine bore wall and the middle region extends along a portion of the at least one engine bore wall between the TDC position and the BDC position of the at least one engine bore wall. One or both of the end regions may have an average porosity of 0.1% to 3%. The middle region may have an average porosity of at least 5%. One or both of the end regions and the middle region may each have an average pore size of 10 to 300 μm. In one embodiment, the coating further includes an intermediate porosity region having an average porosity between the middle region and one or both of the end regions.

In one embodiment, one of the end regions extends along a portion of the at least one engine bore wall that includes a top dead center (TDC) position or a bottom dead center (BDC) position of the at least one engine bore wall, the middle region extends along a portion of the at least one engine bore wall between the TDC position and the BDC position of the at least one engine bore wall, and the intermediate porosity region extends along a portion of the at least one engine bore wall between the one end region and the middle region. The middle region may extend within a portion of the at least one engine bore wall that corresponds to a crankshaft angle of 30 to 150 degrees. The middle region may extend along a portion of the at least one engine bore wall that includes a maximum piston velocity region.

In at least one embodiment, an engine block is provided. The engine block may include a body including a bore wall and a coating overlying the bore wall having a thickness and pores dispersed within the thickness; the coating including a first depth region disposed adjacent an interface of the coating with the bore wall and a second depth region disposed adjacent an exposed surface of the coating, the second depth region having a greater average porosity than the first depth region.

The first depth region may have an average porosity of 0.3% to 2% and the second depth region may have an average porosity of at least 5%. In one embodiment, the coating includes a third depth region disposed between the first and second depth regions within the coating thickness, the third depth region having an average porosity between that of the first and second depth regions. The first and second depth regions may be located within a longitudinal portion of the bore wall that that corresponds to a crankshaft angle of 30 to 150 degrees.

In at least one embodiment, a method if provided including spraying a coating having a first average porosity onto an engine bore wall in a middle longitudinal region; and spraying a coating having a second average porosity onto the engine bore wall in one or more end regions. The first average porosity may be greater than the second average porosity and the first and second average porosities are formed during the spraying steps.

The method may also include spraying a coating having a third average porosity onto the engine bore wall in a third longitudinal region, the third average porosity being less than the first average porosity. The middle longitudinal region may include a longitudinal portion of the bore wall that that corresponds to a crankshaft angle of 80 to 100 degrees. The one or more end regions may include a top dead center (TDC) position or a bottom dead center (BDC) position of the engine bore wall. In one embodiment, the first average porosity is at least 5% and the second average porosity is 0.1% to 3%. The coating having the first average porosity and the coating having the second average porosity may each have an average pore size of 10 to 300 μm and the average pore sizes may be formed during the spraying steps.

In at least one embodiment, an article is provided. The article may include a body including at least one sliding surface wall having a longitudinal axis. A coating may extend along the longitudinal axis and having a coating thickness. The coating may have a middle region and an end region, and a plurality of pores dispersed within the coating thickness. The middle region may have a different average porosity than the end region.

In at least one embodiment an apparatus for spraying a coating is provided. The apparatus may include a spray torch having variable coating parameters and a controller configured to vary the variable coating parameters to produce a coating having a varying porosity along a length and/or depth of the coating.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
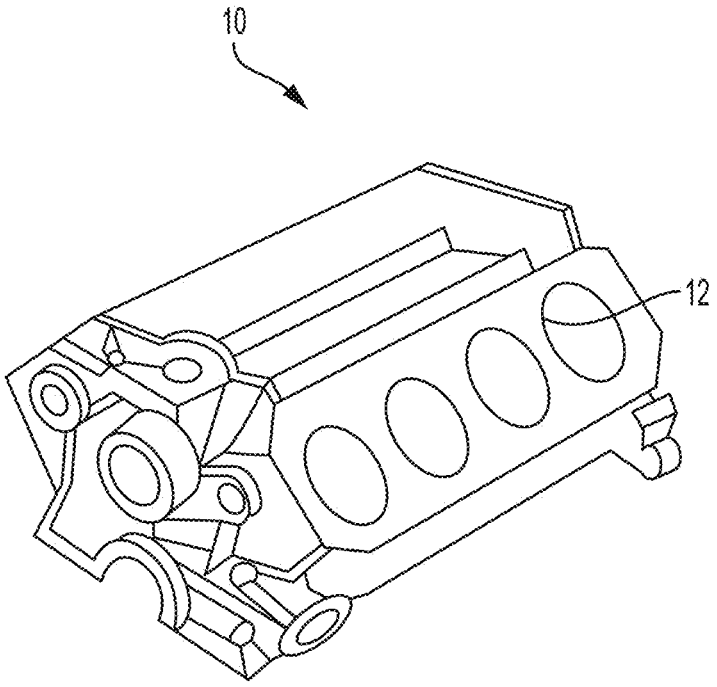
FIG. 1 is a schematic perspective view of an engine block.
Figure 2:
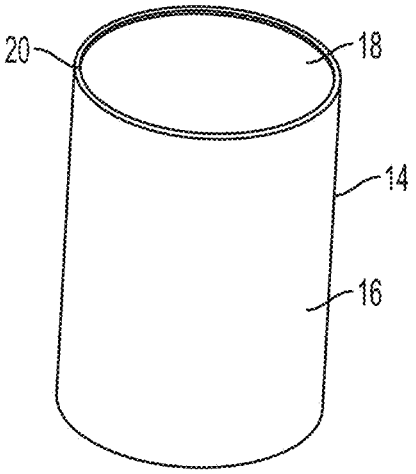
FIG. 2 is a perspective view of a cylinder liner, according to an embodiment.

With reference to FIG. 1, an engine or cylinder block 10 is shown. The engine block 10 may include one or more cylinder bores 12, which may be configured to house pistons of an internal combustion engine. The engine block body may be formed of any suitable material, such as aluminum, cast iron, magnesium, or alloys thereof. In at least one embodiment, the engine block 10 is a liner-less engine block. In these embodiments, the bores 12 may have a coating thereon. In at least one embodiment, the engine block 10 may include cylinder liners 14, such as shown in FIG. 2, inserted into or cast-in to the bores 12. The liners 14 may be a hollow cylinder or tube having an outer surface 16, an inner surface 18, and a wall thickness 20.

If the engine block parent material is aluminum, then a cast iron liner or a coating may be provided in the cylinder bores to provide the cylinder bore with increased strength, stiffness, wear resistance, or other properties. For example, a cast iron liner may cast-in to the engine block or pressed into the cylinder bores after the engine block has been formed (e.g., by casting). In another example, the aluminum cylinder bores may be liner-less but may be coated with a coating after the engine block has been formed (e.g., by casting). In another embodiment, the engine block parent material may be aluminum or magnesium and an aluminum or magnesium liner may be inserted or cast-in to the engine bores. Casting in of an aluminum liner into an aluminum engine block is described in U.S. application Ser. No. 14/972,144 filed Dec. 17, 2015, the disclosure of which is hereby incorporated in its entirety by reference herein.

Accordingly, the bore surface of the cylinder bores may be formed in a variety of ways and from a variety of materials. For example, the bore surface may be a cast-iron surface (e.g., from a cast iron engine block or a cast-iron liner) or an aluminum surface (e.g., from a liner-less Al block or an Al liner). The disclosed variable coating may be applied to any suitable bore surface, therefore, the term bore surface may apply to a surface of a liner-less block or to a surface of a cylinder liner or sleeve that has been disposed within the cylinder bore (e.g., by interference fit or by casting-in).

Figure 3:
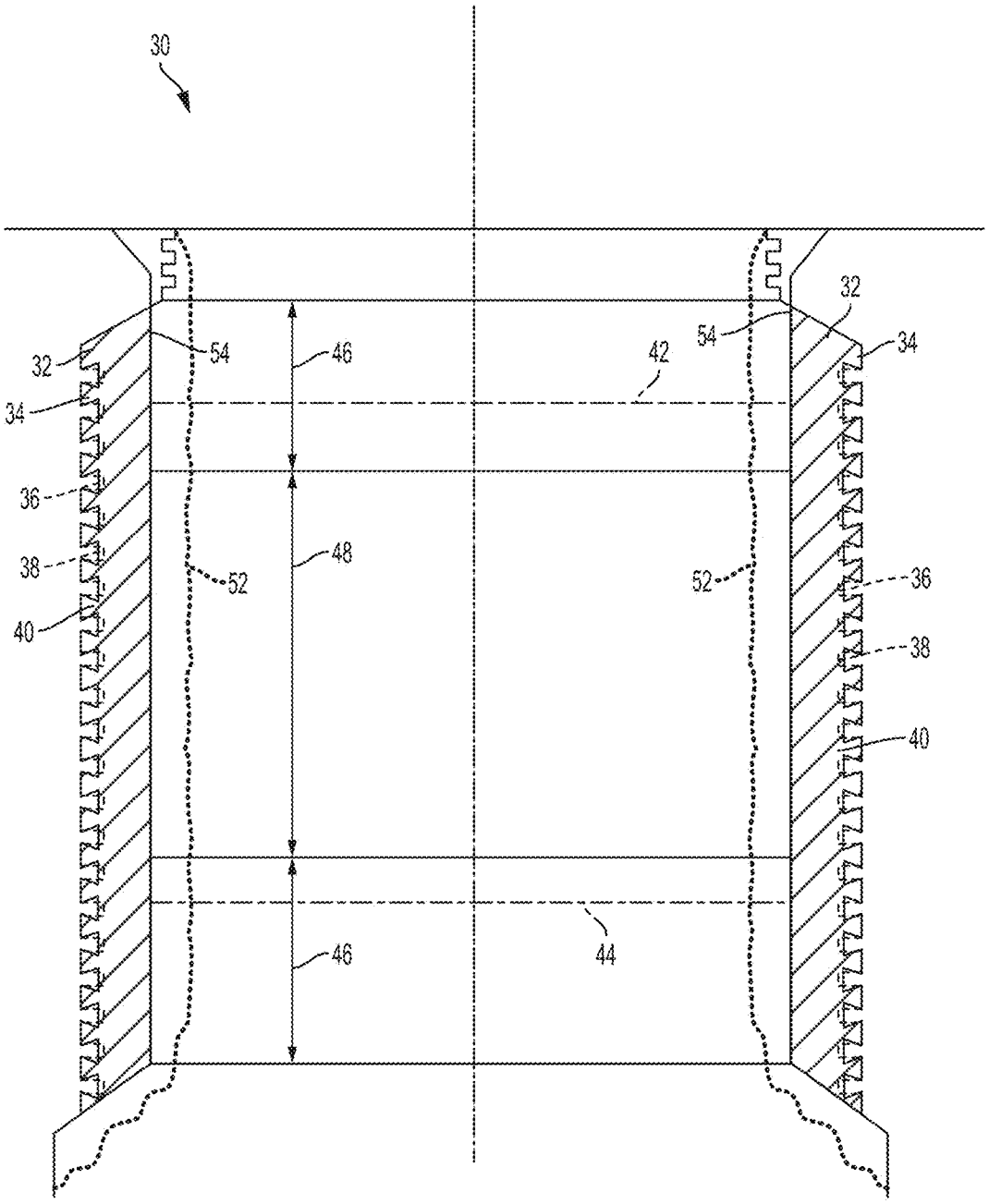
FIG. 3 is a cross-section of a coated engine bore, according to an embodiment.

With reference to FIG. 3, a cylinder bore 30 having a variable coating 32 is disclosed. While a cylinder bore is shown and described, the present disclose may apply to any article comprising a body including at least one sliding surface wall having a longitudinal axis. Prior to applying the coating 32, the bore surface 34 may be roughened. Roughening the bore surface 34 may improve the adhesion or bonding strength of the coating 32 to the bore 30. The roughening process may be a mechanical roughening process, for example, using a tool with a cutting edge, grit blasting, or water jet. Other roughening processes may include etching (e.g., chemical or plasma), spark/electric discharge, or others. In the embodiment shown, the roughening process may be multiple steps. In the first step, material may be removed from the bore surface 34 such that projections 36 are formed (in dashed lines). In the second step, the projections may be altered to form overhanging projections 38 having undercuts 40. The projections may be altered using any suitable process, such as rolling, cutting, milling, pressing, grit blasting, or others.

The coating 32 may be applied to the roughed bore surface. In one embodiment, the coating may be a sprayed coating, such as a thermally sprayed coating. Non-limiting examples of thermal spraying techniques that may be used to form the coating 32 may include plasma spraying, detonation spraying, wire arc spraying (e.g., plasma transferred wire arc, or PTWA), flame spraying, high velocity oxy-fuel (HVOF) spraying, warm spraying, or cold spraying. Other coating techniques may also be used, such as vapor deposition (e.g., PVD or CVD) or chemical/electrochemical techniques. In at least one embodiment, the coating 32 is a coating formed by plasma transferred wire arc (PTWA) spraying.

An apparatus for spraying the coating 32 may be provided. The apparatus may be a thermal spray apparatus including a spray torch. The spray torch may include torch parameters, such as atomizing gas pressure, electrical current, plasma gas flow rate, wire feed rate and torch traverse speed. The torch parameters may be variable such that they are adjustable or variable during the operation of the torch. The apparatus may include a controller, which may be programmed or configured to control and vary the torch parameters during the operation of the torch. As described in further detail, below, the controller may be programmed to vary the torch parameters to adjust the porosity of the coating 32, in a longitudinal and/or depth direction. The controller may include a system of one or more computers which can be configured to perform particular operations or actions by virtue of having software, firmware, hardware, or a combination thereof installed on the system that in operation causes or cause the system to perform the disclosed actions. One or more computer programs can be configured to perform particular operations or actions by virtue of including instructions that, when executed by the controller, cause the apparatus to perform the actions.

The coating 32 may be any suitable coating that provides sufficient strength, stiffness, density, wear properties, friction, fatigue strength, and/or thermal conductivity for an engine block cylinder bore. In at least one embodiment, the coating may be an iron or steel coating. Non-limiting examples of suitable steel compositions may include any AISI/SAE steel grades from 1010 to 4130 steel. The steel may also be a stainless steel, such as those in the AISI/SAE 400 series (e.g., 420). However, other steel compositions may also be used. The coating is not limited to irons or steels, and may be formed of, or include, other metals or non-metals. For example, the coating may be a ceramic coating, a polymeric coating, or an amorphous carbon coating (e.g., DLC or similar). The coating type and composition may therefore vary based on the application and desired properties. In addition, there may be multiple coating types in the cylinder bore 30. For example, different coating types (e.g., compositions) may be applied to different regions of the cylinder bore (described in more detail below) and/or the coating type may change as a function of the depth of the overall coating (e.g., layer by layer).

During the stroke of the piston inside the cylinder bore, the friction condition may change based on the crank angle or the location and/or speed of the piston. For example, when the piston is at or near the top dead center (TDC) 42 and/or the bottom dead center (BDC) 44, the speed of the piston may be small or zero, at the very top and bottom of the stroke (e.g., near crank angles of 0 and 180 degrees). When the piston is at or near TDC 42 or BDC 44, the friction condition may be boundary friction, wherein there is asperity contact between the piston and the bore surface (or coating surface, when coated). When the piston is moving at relatively high speeds in a middle section of the bore length/height (e.g., crank angle between about 35 to 145 degrees), the friction condition may be hydrodynamic friction, wherein there is little or no asperity contact. When the piston is between these two regions (e.g., crank angle between about 10 to 35 or about 145 to 170), either moving toward or away from TDC 42 or BDC 44, the piston speed is relatively moderate and the friction condition may be mixed boundary and hydrodynamic friction (e.g., some asperity contact). Of course, the crank angles disclosed herein are examples, and the transition to different friction conditions (e.g., boundary to mixed) will depend on the speed of the engine, the engine architecture, and other factors.

Accordingly, the lubrication properties or requirements may be different in different regions of the cylinder bore 30. In at least one embodiment, the porosity of the coating 32 may vary along the height of the bore 30. As used herein, porosity may refer to pores that are formed during the deposition of the coating 32 or that may be formed in the coating 32 after it is deposited (e.g., through texturing mechanically or chemically). The pores in the coating 32 may act as reservoirs to hold oil/lubricant, thereby providing lubrication in severe operating conditions or improving lubricant film thickness. Therefore, regions having different levels of porosity may have different effects on the lubrication of the cylinder bore 30. In at least one embodiment, there may be at least two different porosity levels along the height of the bore 30. There may be a relatively low porosity region 46 and a relatively high porosity region 48. In the embodiment shown in FIG. 3, there may be two low porosity regions 46 and a high porosity region 48 in between (e.g., separating the regions 46).

One low porosity region 46 may extend over a height of the cylinder bore 30 that includes the TDC 42. The region 46 may extend below the TDC 42 by a certain amount. For example, the region 46 may cover a certain height of the cylinder bore according to the crank angle of the piston. In one embodiment, the region 46 may extend from TDC 42 to a height corresponding to a crank angle of up to 35 degrees. In another embodiment, the region 46 may extend from TDC 42 to a height corresponding to a crank angle of up to 30, 25, 20, 15, or 10 degrees. For example, the region may extend from 0 to 35, 0 to 30, 0 to 25, 0 to 20, 0 to 15, 0 to 10, or 0 to 5 degrees.

Another low porosity region 46 may extend over a height of the cylinder bore 30 that includes the BDC 44. The region 46 may extend above the BDC 44 by a certain amount. For example, the region 46 may cover a certain height of the cylinder bore according to the crank angle of the piston. In one embodiment, the region 46 may extend from BDC 44 to a height corresponding to a crank angle of at most 145 degrees. In another embodiment, the region 46 may extend from BDC 44 to a height corresponding to a crank angle of at most 150, 155, 160, 165, or 170 degrees. For example, the region may extend from 145 to 180, 150 to 180, 155 to 180, 160 to 180, 165 to 180, 170 to 180, or 175 to 180 degrees.

The high porosity region 48 may be disposed between the low porosity regions 46. In one embodiment, the high porosity region 48 may extend the entire height between the low porosity regions 46, as shown in FIG. 3. Similar to the low porosity regions 46, the high porosity region 48 may cover a certain height of the cylinder bore according to the crank angle of the piston. The range of crank angles may be any range between those disclosed above for the top and bottom low porosity regions 46. For example, the high porosity region may extend from a crank angle of 10 to 170 degrees, 15 to 165 degrees, 20 to 160 degrees, 25 to 155 degrees, 30 to 150 degrees, or 35 to 145 degrees, or it may extend at least a portion within any of the above ranges. The top and bottom low porosity regions 46 may or may not be the same height. Therefore, the crank angle ranges may be asymmetrical and may extend from any value disclosed above for the top region 46 to any region for the bottom region 46. For example, the high porosity region 48 may extend from a crank angle of 15 to 160 degrees.

Similar to crank angle, the low porosity region(s) 46 and high porosity region 48 may cover areas (e.g., height ranges) of the bore surface that correspond to where the piston has a certain velocity. The low porosity region(s) 46 may correspond to areas or relatively low (or no) velocity, while the high porosity region 48 may correspond to areas of relatively high (or max) velocity. The velocity of the piston may change depending on the design or configuration of the engine. Accordingly, the areas of the high or low porosity regions may be described in terms of a percentage of the maximum (max) velocity of the piston.

In one embodiment, the low porosity region(s) 46 may cover an area of the cylinder bore surface that corresponds to a piston velocity of up to 30% of the max velocity (including zero velocity), for example, up to 25%, 20%, 15%, 10%%, or 5% of the max velocity. As described above, the lower velocities may occur at or near the TDC 42 and/or BDC 44. The high porosity region 48 may cover the balance of the cylinder bore area. For example, the high porosity region 48 may cover an area of the cylinder bore surface that corresponds to a piston velocity of at least 5%, 10%, 15%, 20%, 25%, or 30% of the max velocity. In another embodiment, the high porosity region 48 may cover an area of the cylinder bore surface that corresponds to a piston velocity of 50% to 100% of the max velocity, or any sub-range therein, such as 60% to 100%, 70% to 100%, 80% to 100%, 90% to 100%, or 95% to 100 of the max velocity.

In one embodiment, the porosity (e.g., average porosity) of the low porosity regions 46 may be up to 3%. For example, the low porosity regions 46 may have a porosity of up to 2.5%, 2%, or 1.5%. In one embodiment, the low porosity regions 46 may have a porosity of 0.1% to 3%, or any sub-range therein, such as 0.5% to 3%, 0.5% to 2.5%, 0.5% to 2%, 1% to 2.5%, or 1% to 2%. As disclosed herein, "porosity" may refer to a surface porosity, or a percentage of the surface of the coating that is made up of pores (e.g., empty space or air, prior to introduction of lubricant).

The porosity of the high porosity region 48 may be greater than the porosity of the low porosity region(s) 46. In one embodiment, the high porosity region 48 may have a porosity (e.g., average porosity) of at least 2%, for example, at least 2.5%, 3%, 3.5%, 4%, 4.5%, or 5%. In another embodiment, the high porosity region 48 may have a porosity of 2% to 15%, or any sub-range therein, such as 2% to 12%, 2% to 10%, 2% to 8%, 3% to 10%, 3% to 8%, 4% to 10%, 4% to 8%, 5% to 10%, or 5% to 8%.

The size or diameter of the pores, the pore depth, and/or the pore distribution in the low and high porosity regions may be the same or may be different. In one embodiment, the mean or average pore sizes of the low porosity regions 46 and the high porosity region 48 may be the same or similar. In this embodiment, the average pore sizes of the low porosity regions 46 and the high porosity region 48 may be from 0.1 to 500 μm, or any sub-range therein, such as 0.1 to 250 μm, 0.1 to 200 μm, 1 to 500 μm, 1 to 300 μm, 1 to 200 μm, 10 to 300 μm, 10 to 200 μm, 20 to 200 μm, 10 to 150 μm, or 20 to 150 μm.

In another embodiment, the average pore sizes, pore depth, and/or pore distribution of the low porosity regions 46 and the high porosity region 48 may be different. For example, the average pore size of the high porosity region 48 may be greater than the average pore size of the low porosity regions 46, or vice versa. The average pore sizes may be within the ranges disclosed above, but with one being greater than the other within the range. The porosity of each region may be a function of the pore size and the number of pores. Therefore, for a given average pore size, a greater number of pores will result in a higher porosity, and vice versa. If the average pore size differs between regions, then the relationship between porosity and number of pores may be more complex. For example, the high porosity region 48 may have the same number of pores as the low porosity region 46, but may have a greater number of pores. Alternatively, the high porosity region 48 may have smaller pores but may have a greater number of pores to the extent that the overall porosity is still greater than the low porosity region 46. Of course, the high porosity region 48 may have both larger pores and a greater number.

While the coating 32 on the cylinder bore 30 has been described above with two different porosity regions, there may be more than two different porosity regions, such as 3, 4, 5, or more different regions. In some embodiments, instead of discrete regions, there may be a gradient of porosity along the height of the cylinder bore 30. For example, instead of discrete low porosity regions 46 and a high porosity region 48, the porosity of the coating 32 may increase from the TDC 42 to a peak in a center region of the bore height and then decrease towards the BDC 44. Accordingly, there may be a relative minimum porosity at or near the TDC 42, a relative maximum porosity near a center region of the bore height (e.g., at a crank angle around 90 degrees, such as 80 to 100 degrees), and another relative minimum at or near the BDC 44. The change in porosity may be continuous and may be a linear/constant increase/decrease or may be a curve. The change in porosity may also be comprised of a plurality of small steps in porosity having two or more regions (e.g., 2 to N regions). In addition to, or instead of, the porosity levels of the regions changing as a gradient or a plurality of steps, the pore sizes may also change in a similar manner.

Figure 4:
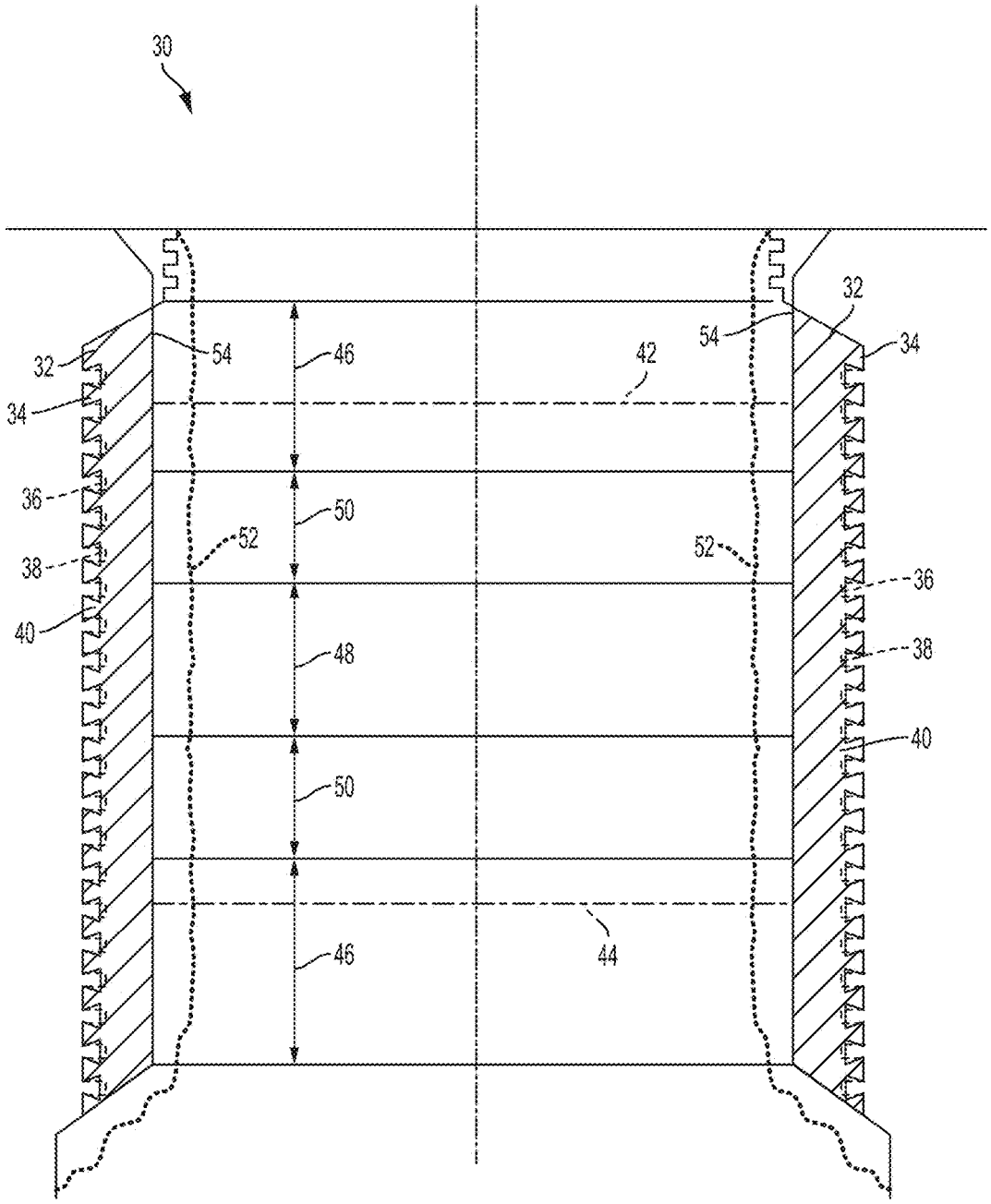
FIG. 4 is a cross-section of a coated engine bore, according to another embodiment.

Another example of a cylinder bore 30 having a coating 32 is shown in FIG. 4. Similar to the embodiment shown in FIG. 3, the coating shown in FIG. 4 also has a relatively low porosity region 46 and a relatively high porosity region 48. In addition, the coating shown in FIG. 4 may also have an intermediate porosity region 50, which may have a porosity level that is between that of the low porosity region and high porosity region 48. In the example shown in FIG. 4, there may be two low porosity regions 46 and a single high porosity region 48, similar to FIG. 3. However, there may be two intermediate porosity regions 50, one located or disposed between the low and high porosity regions along the height of the bore 30. Accordingly, from the TDC 42 to the BDC 44, the order of the regions may be as follows: low-intermediate-high-intermediate-low.

In one embodiment, the low porosity region(s) 46 and the high porosity region 48 in FIG. 4 may have the same or similar porosity values as described above for FIG. 3. However, the low and high porosity regions in FIG. 4 may have different values, for example, the ranges may be narrowed to provide a porosity level gap for the intermediate porosity regions 50. In one embodiment, the porosity (e.g., average porosity) of the intermediate porosity regions 50 may be from 2% to 7%, or any sub-range therein, such as 2% to 6%, 3% to 7%, 3% to 5%, 4% to 7%, or 4% to 6%. Similar to the description of FIG. 3, the size or diameter of the pores in the low, intermediate, and high porosity regions may be the same or may be different. The average pore sizes may be the same or similar to those described above. In embodiments where the average pore sizes of the low porosity regions 46, intermediate porosity regions 50, and the high porosity region 48 are different, the average pore size of the intermediate porosity regions 50 may be between the average pore size of the high porosity region 48 and the low porosity regions 46. Similar to above, the porosity of the intermediate region(s) 50 may be a function of the size and/or the number of pores. For example, the number of pores may be the same as the low and high porosity regions, but the size may be intermediate. Alternatively, the sizes of the pores may all be the same, but the intermediate region may have an intermediate number of pores. Of course, there may be other combinations of pore size and number that also result in an intermediate overall porosity.

In the embodiment shown in FIG. 4, the high porosity region 48 may extend over a central or middle portion of the cylinder bore height. For example, the high porosity region 48 may extend over the height of the cylinder bore corresponding to a crank angle of 90 degrees. In one embodiment, the high porosity region 48 may extend over the height of the cylinder bore corresponding to a crank angle of 60 to 120 degrees, or any sub-range therein, such as 70 to 110 degrees or 80 to 100 degrees, or extend over at least a portion of the ranges above. The low porosity regions 46 may extend over the same or similar crank angle ranges as described in FIG. 3. Accordingly, the crank angle ranges of the intermediate porosity regions 50 may be between the ranges for the low and high porosity ranges.

Similar to above, the low, intermediate, and high porosity areas may be described in terms of the area or height of the cylinder that corresponds to a piston velocity. Accordingly, the low porosity region(s) 46 may cover an area of the cylinder bore surface that corresponds to a relatively low piston velocity (e.g., including zero), the high porosity region(s) 48 may cover an area of the cylinder bore surface that corresponds to a relatively high piston velocity (e.g., including the max velocity), and intermediate porosity region(s) 50 may cover an area of the cylinder bore surface that corresponds to a piston velocity between that of the low and high velocity areas (e.g., not including zero or the max).

In one embodiment, the low porosity region(s) 46 may cover an area of the cylinder bore surface that corresponds to a piston velocity of up to 30% of the max velocity (including zero velocity), for example, up to 25%, 20%, 15%, 10%%, or 5% of the max velocity. As described above, the lower velocities may occur at or near the TDC 42 and/or BDC 44. The intermediate porosity region(s) 50 may cover an area of the cylinder bore surface that corresponds to a piston velocity of 5% to 80% of the max velocity, or any sub-range therein. For example, the intermediate porosity region(s) 50 may cover an area corresponding to 10% to 80%, 15% to 80%, 20% to 80%, 30% to 80%, 40% to 80%, 30% to 70%, 30% to 60%, 20% to 50%, or 10% to 50% of the max velocity, or others. In one embodiment, the high porosity region(s) 48 may cover an area of the cylinder bore surface that corresponds to a piston velocity of at least 30%, 40%, 50%, 60%, 70%, or 80% of the max velocity (including max). In another embodiment, the high porosity region 48 may cover an area of the cylinder bore surface that corresponds to a piston velocity of 50% to 100% of the max velocity, or any sub-range therein, such as 60% to 100%, 70% to 100%, 80% to 100%, 90% to 100%, or 95% to 100 of the max velocity. In one embodiment, the percentage of max velocity of the intermediate porosity regions 50 may be between and/or form the balance of the ranges for the low and high porosity ranges.

The coating 32 may be a single layer or may be formed of multiple layers. For example, if the coating 32 is applied using a thermal spray method (e.g., PTWA), there may be multiple layers sprayed onto the bore surface to build up the coating 32 to its final thickness. The thermal spray may be applied by a rotating nozzle or by rotating the bore surface around a stationary nozzle. Accordingly, each revolution of the nozzle and/or bore surface may deposit a new layer when forming the coating 32. As described above, the porosity levels (e.g., the low, intermediate, or high porosity regions) may be surface porosity levels. However, there may also be variation in the porosity as a function of the depth of the coating 32.

In one embodiment, the coating 32 may have a honed thickness of 25 to 500 μm, for example, 25 to 250 μm, 50 to 500 μm, 50 to 250 μm, 25 to 100 μm, or 25 to 75 μm. It has been discovered that the porosity of the coating 32 may affect the adhesion or bonding of the coating 32 to the bore surface (e.g., aluminum bore or sleeve). In general, the adhesion of the coating 32 to the bore surface may increase with reduced porosity. Accordingly, in at least one embodiment, the average porosity of the coating 32 may be smaller at the interface between the coating 32 and the bore surface than at the surface of the coating 32 (e.g., the exposed surface that contacts the piston).

Similar to the surface porosity regions, there may be two or more discrete regions of porosity along the thickness of the coating or there may be a gradient or constantly changing porosity along the thickness. The porosity of the coating 32 at the interface with the bore surface may be up to 2%, for example, 0.1% to 2%, 0.3% to 2%, 0.5% to 2%, 0.1% to 1.5%, 0.1% to 1%, 0.5% to 2%, or 0.5% to 1.5%. The porosity of the coating 32 at the surface is described above, and may vary depending on the location of the coating along the height of the cylinder bore 30. Accordingly, there may be variations in the porosity along both the height and the depth of the coating 32 along the cylinder bore 30.

The change in porosity along the coating thickness may be comprised of a plurality of small steps in porosity having two or more regions (e.g., 2 to N regions). In one embodiment, the regions may correspond to the thickness of a single layer of the coating as it is applied. For example, if five layers of PTWA are deposited and each has a thickness of 10 μm, the total coating thickness may be 50 μm. The porosity may be adjusted during each, some, or all of the layer depositions. For example, the porosity may increase in each subsequent layer such that the porosity increases continuously from the interface to the surface of the coating 32. Alternatively, some layers may be formed with the same porosity such that there are steps in porosity from the interface to the surface of the coating.

In addition to variations in the porosity and/or pore size in the coating 32 as a function of height and/or depth of the cylinder bore, there may be variations in other properties, as well. In one embodiment, the microhardness of the coating may vary depending on the height within the cylinder bore. For example, the microhardness may vary in a similar manner to the porosity such that there are regions or zones within the engine bore with different microhardnesses. Accordingly, the low, high, and/or intermediate porosity regions may also have different microhardness levels. Similar to porosity, there may be two, three, four, or more different microhardness regions. The microhardness may change in a step-wise manner or may be continuous or substantially continuous (e.g., lots of very small discrete changes). Similar to the porosity, the microhardness may be varied by adjusting parameters of the coating deposition process, such as the torch parameters.

In one embodiment, the microhardness of the coating 32 may be greater in regions of lower porosity than in regions of higher porosity. For example, in some embodiments, the lower porosity regions 46 may also be high microhardness regions. Regions including and adjacent to the TDC 42 and BDC 44 may have higher microhardnesses than regions where the piston travels at relatively high velocity (e.g., crank angle of about 90 degrees). The microhardness in the high microhardness regions may be from 150 to 600 HV, or any sub-range therein. For example, the microhardness in the high microhardness regions may be from 200 to 500 HV, 200 to 400 HV, 250 to 500 HV, or 250 to 400 HV. In some embodiments, the microhardness of the entire coating may be within the above ranges, however, the high microhardness regions may have a greater microhardness within the range.

Figure 5:
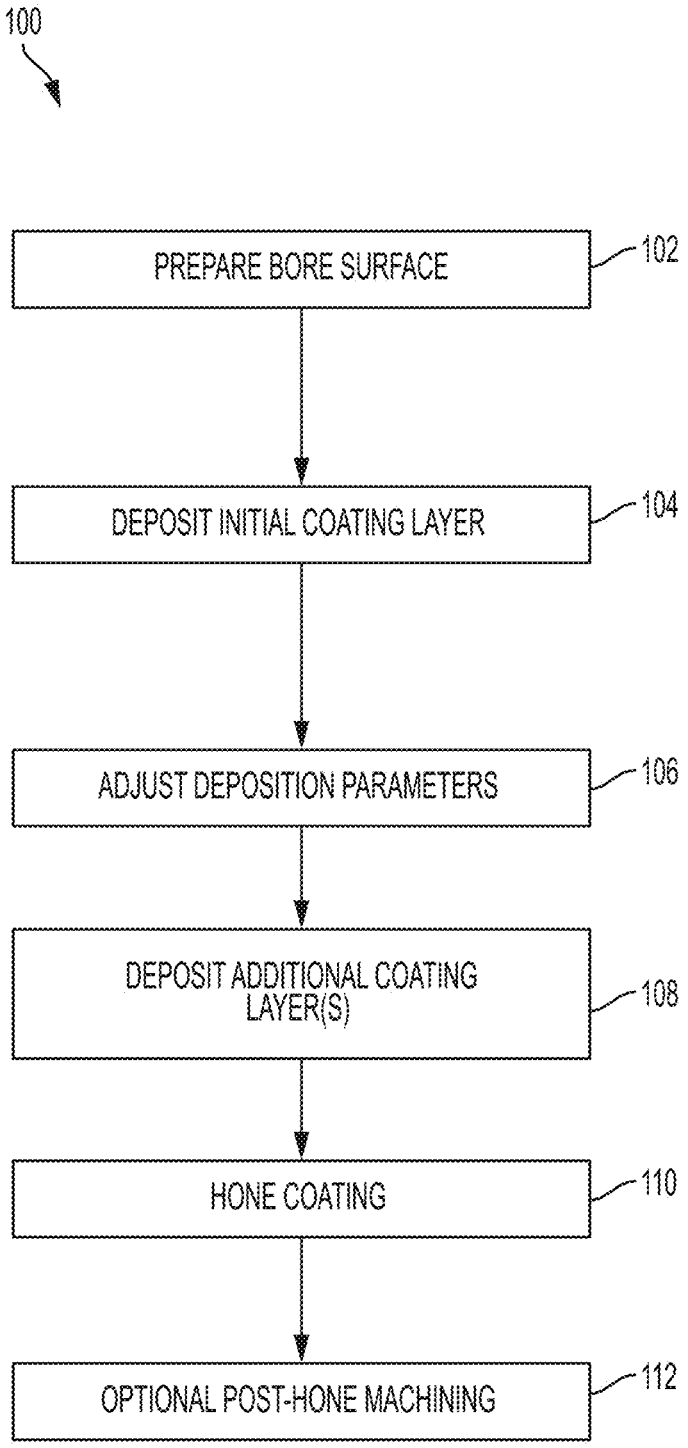
FIG. 5 is an example of a flowchart for forming a cylinder bore having a variable porosity coating, according to an embodiment.

With reference to FIGS. 3-5, methods of forming the disclosed variable porosity coatings are described. FIG. 5 shows a flowchart 100 of a method for forming a cylinder bore coating having variable porosity. As described above, however, the method may apply to forming a coating having variable porosity on any article body including at least one sliding surface wall having a longitudinal axis. In step 102, the bore surface may be prepared to receive the coating. As described above, the bore surface may be a cast engine bore or a liner (cast-in or interference fit). The surface preparation may include roughening and/or washing of the surface to improve the adhesion/bonding of the coating.

In step 104, the deposition of the coating may begin. As described above, the coating may be applied in any suitable manner, such as spraying. In one example, the coating may be applied by thermal spraying, such as PTWA spraying. The coating may be applied by rotational spraying of the coating onto the bore surface. The spray nozzle, the bore surface, or both may be rotated to apply the coating. As disclosed above, the portion of the coating at the interface with the bore surface may have a low porosity to promote bonding/adhesion. Therefore, the initial layer of the coating may be the same along an entire height of the cylinder bore coating. However, in other embodiments, there may be variation in the initial coating porosity based on height.

In step 106, the deposition parameters may be adjusted (e.g., by a controller) to produce varying levels of porosity in the coating. The adjustments may be made while the coating is being applied or the application may be paused to adjust the parameters. The parameters may be adjusted to form the coating structure(s) described above. For example, the parameter may be adjusted to form low, intermediate, and/or high porosity regions at the surface of the coating in the disclosed locations. The parameters may also be adjusted to form the changes in porosity as a function of the depth of the coating, as described. The parameters to be adjusted may vary based on the type of deposition and specific equipment used. In the example where PTWA spraying is used, the torch, or other operating parameters may be adjusted to change the porosity. For example, it has been discovered that parameters such as the atomizing gas pressure, electrical current, plasma gas flow rate, wire feed rate and torch traverse speed may be adjusted to increase or decrease the porosity of the coating. Adjusting these parameters may change the size, temperature, and velocity of the metal particles and consequently change the microstructure and/or composition of the coating in favor of higher or lower porosity levels.

In step 108, additional layers of the coating may be applied using the adjusted deposition parameters. While steps 104, 106, and 108 are shown as separate steps, two or all three may be combined into a single step in practice. The parameters may be adjusted during the deposition process such that the layers are formed having varying porosities at different heights/thicknesses. In addition, if there are multiple layers within the overall coating, the layers may have the same or different thicknesses. For example, each layer may have the same thickness, such as 5, 10, 15, or 20 μm, or there may be two or more different layer thicknesses within the overall coating.

In step 110, the finished coating may be honed to a final bore diameter according to specified engine bore dimensions. In some embodiments, an optional mechanical machining operation, such as boring, cubing, etc., may be performed prior to honing in order to reduce the amount of stock removal during honing. In general, the honing process includes inserting a rotating tool having abrasive particles into the cylinder bore to remove material to a controlled diameter. In the embodiments shown in FIGS. 3 and 4, the coating 32 may initially be deposited to a thickness 52, shown in a dashed line. The honing process may remove material from the coating 32 and provide a highly cylindrical bore wall 54 having the final bore diameter. As described herein, the coating surface for the purpose of porosity may be the surface that results from the honing process, not the initial surface after deposition (e.g., the bore wall 54, not the initial thickness 52).

After the honing step, optional post-hone machining may be performed in step 112. This step may include additional conventional machining processes to finalize the cylinder bore. In addition, step 112 may include machining processes to open or create additional pores in the surface of the coating 32. For example, there may be an additional wash step, such as a high-pressure wash (e.g., with water or other fluid), a brushing step, or a dry ice blasting step.

Figure 6:
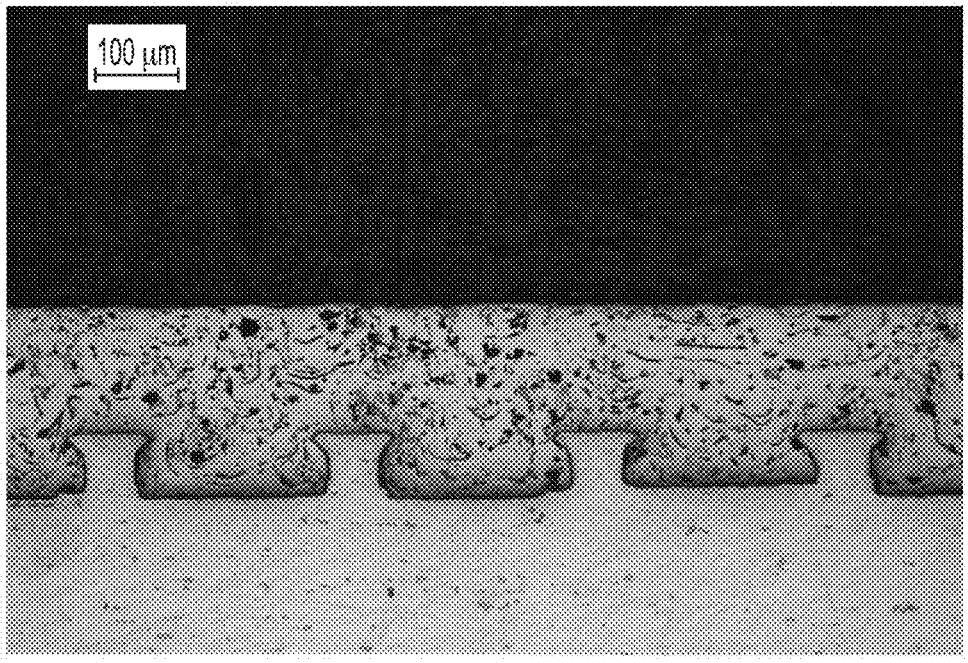
FIG. 6 is a cross-section of a PTWA coating having a relatively intermediate porosity level, according to an embodiment.
Figure 7:
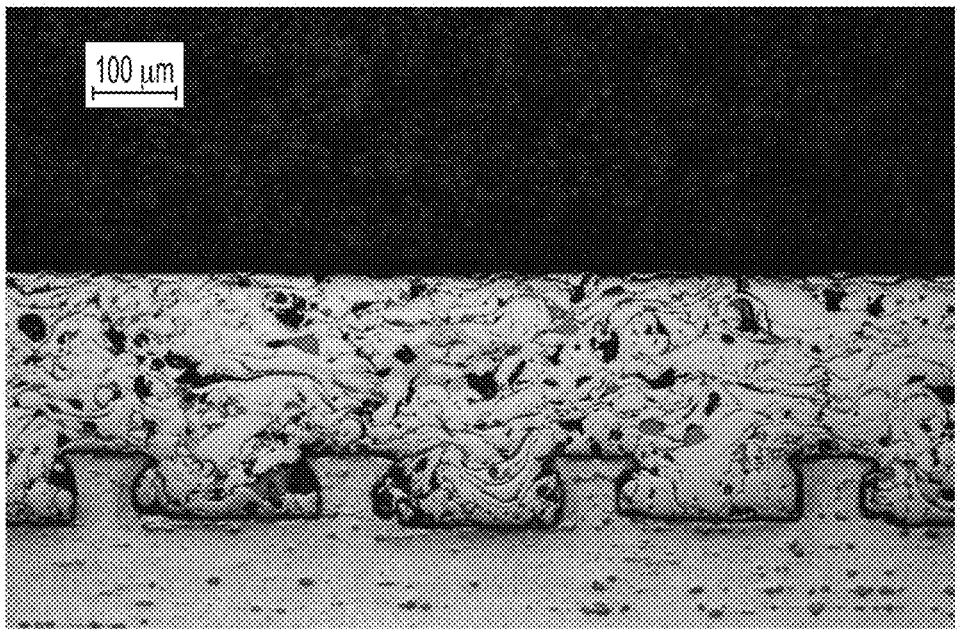
FIG. 7 is a cross-section of a PTWA coating having a relatively high porosity level, according to an embodiment.

With reference to FIGS. 6 and 7, cross-sections of two examples of PTWA coatings are shown having different porosities. FIG. 6 shows a PTWA coating having a relatively medium or moderate porosity of 6.73%. FIG. 7 shows a PTWA coating having a relatively high porosity of 8.65%. Accordingly, the coatings in FIGS. 6 and 7 could be used as intermediate and high porosity regions, respectively, as described above. As shown, the pores are dispersed within and throughout the coating, including at the interface with the cylinder wall (e.g., a liner or an as-cast block), in the bulk of the coating, and at/near the surface of the coating.

It has been discovered, the disclosed cylinder bore having a variable coating may improve the lubrication of the cylinder, as well as reduce friction and wear. As described above, when the piston is at or near TDC 42 or BDC 44, the friction condition may be boundary friction, wherein there is asperity contact between the piston and the bore surface (or coating surface, when coated). This friction condition may not require large amounts of lubrication to fill the small gaps between the piston and the bore/coating surface. Therefore, the coating may have relatively low porosity in the regions where boundary friction occurs (e.g., at zero and low piston velocities and corresponding crank angles).

When the piston is moving at relatively high speeds in a middle section of the bore length/height, the friction condition may be hydrodynamic friction, wherein there is little or no asperity contact and a larger gap between the piston and the bore/coating surface. This friction condition may require larger amounts of lubrication to fill the larger gaps between the piston and the bore/coating surface. Therefore, the coating may have relatively high porosity in the regions where hydrodynamic friction occurs (e.g., at max and near-max piston velocities and corresponding crank angles).

When the piston is between these two regions, either moving toward or away from TDC 42 or BDC 44, the piston speed is relatively moderate and the friction condition may be mixed boundary and hydrodynamic friction (e.g., some asperity contact). This friction condition may require intermediate amounts of lubrication to fill the moderate gaps between the piston and the bore/coating surface. Therefore, the coating may have relatively intermediate porosity in the regions where mixed friction occurs (e.g., at intermediate piston velocities and corresponding crank angles).

In addition to the friction condition, the piston velocity also changes as a function of the piston position in the cylinder bore. At TDC and BDC, the velocity is zero or substantially zero and is relatively low at crank angles near TDC/BDC. The velocity increases as the piston moves towards the cylinder middle/center and may reach a maximum at or near the middle/center (e.g., at or about a 90 degree crank angle). Friction forces may change as a function of velocity, generally increasing as velocity increases. Accordingly, it has been discovered that providing increased porosity levels in the cylinder bore coating at the regions of max velocity may improve lubrication and reduce friction. As described above, the porosity may be varied along the height of the bore to correspond to the friction condition, piston velocity, and/or crank angle in order to provide a certain amount of lubrication in each area. There may be two or more regions of different porosity (e.g., 2, 3, 4, 5, or more) or the porosity may be adjusted continuously or in very small discrete steps.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. An engine block, comprising:

a body including a bore wall and a coating overlying the bore wall having a thickness and pores dispersed within the thickness;

the coating including a first depth region disposed adjacent an interface of the coating with the bore wall and a second depth region disposed adjacent an exposed surface of the coating, the second depth region having a greater average porosity than the first depth region, the coating further includes a third depth region disposed between the first and second depth regions within the coating thickness, and the third depth region having an average porosity between that of the first and second depth regions.

2. The engine block of claim 1, wherein the first, second and third depth regions extend along a portion of the at least one engine bore wall that includes a maximum piston velocity region.

3. The engine block of claim 1, wherein the first depth region has an average porosity of 0.3% to 2% and the second depth region has an average porosity of at least 5%.

4. The engine block of claim 1, wherein the first, second, and third depth regions are located within a longitudinal portion of the bore wall that that corresponds to a crankshaft angle of 30 to 150 degrees.

5. The engine block of claim 1, wherein the first, second and third depth regions have first, second and third thicknesses, respectively, the first, second and third thicknesses are the same.

6. The engine block of claim 1, wherein the first, second and third depth regions have first, second and third microhardnesses.

7. The engine block of claim 6, wherein the first microhardness is greater than the second microhardness.

8. The engine block of claim 7, wherein the first microhardness is in a range of 150 to 600 HV.

9. The engine block of claim 7, wherein the first microhardness is in a range of 250 to 400 HV.

10. An engine block, comprising:

a body including a bore wall and a sprayed coating overlying the bore wall having a thickness and pores dispersed within the thickness;

the sprayed coating including a first depth region disposed adjacent an interface of the sprayed coating with the bore wall and a second depth region disposed adjacent an exposed surface of the sprayed coating, the second depth region having a greater average porosity than the first depth region, the sprayed coating further includes a third depth region disposed between the first and second depth regions within the coating thickness, and the third depth region having an average porosity between that of the first and second depth regions.

11. The engine block of claim 10, wherein the first, second and third depth regions have first, second and third thicknesses, respectively, the first, second and third thicknesses are the same.

12. The engine block of claim 10, wherein the first, second and third depth regions have first, second and third microhardnesses.

13. The engine block of claim 12, wherein the first microhardness is greater than the second microhardness.

14. The engine block of claim 13, wherein the first microhardness is in a range of 150 to 600 HV.

15. The engine block of claim 13, wherein the first microhardness is in a range of 250 to 400 HV.

16. An engine block, comprising:

a body including a bore wall and an iron or steel coating overlying the bore wall having a thickness and pores dispersed within the thickness;

the iron or steel coating including a first depth region disposed adjacent an interface of the iron or steel coating with the bore wall and a second depth region disposed adjacent an exposed surface of the iron or steel coating, the second depth region having a greater average porosity than the first depth region, the iron or steel coating further includes a third depth region disposed between the first and second depth regions within the coating thickness, and the third depth region having an average porosity between that of the first and second depth regions.

17. The engine block of claim 16, wherein the first, second and third depth regions have first, second and third thicknesses, respectively, the first, second and third thicknesses are the same.

18. The engine block of claim 16, wherein the first, second and third depth regions have first, second and third microhardnesses.

19. The engine block of claim 18, wherein the first microhardness is greater than the second microhardness.

20. The engine block of claim 18, wherein the first microhardness is in a range of 150 to 600 HV.

* * * * *